United States Patent [19]

Holley

[11] 4,165,280

[45] Aug. 21, 1979

[54] METHOD AND MEANS FOR CLEANING FEED HOPPERS

[76] Inventor: Jasper B. Holley, Rte. 1, Box 196, Johnston, S.C. 29832

[21] Appl. No.: 895,570

[22] Filed: Apr. 12, 1978

[51] Int. Cl.[2] ..... B07B 1/04; B07B 1/52

[52] U.S. Cl. ..... 209/245; 209/261; 209/358; 209/259; 209/390; 198/616

[58] Field of Search ..... 209/241, 245, 257, 262, 209/261, 358, 390, 259, 373; 198/688, 698, 699, 616, 550; 19/105

[56] References Cited

U.S. PATENT DOCUMENTS

| | | | |
|---|---|---|---|
| 201,676 | 3/1878 | Hunt | 209/261 |
| 242,963 | 6/1881 | Newton | 209/261 |
| 379,267 | 3/1888 | Butcher et al. | 209/373 |
| 633,995 | 10/1899 | Graves | 209/261 |
| 1,554,750 | 9/1925 | Mihaut | 209/358 X |
| 2,721,359 | 10/1955 | Morgan | 209/245 |
| 3,321,079 | 5/1967 | Sackett | 209/358 X |

*Primary Examiner*—Ralph J. Hill
*Attorney, Agent, or Firm*—Clifton T. Hunt

[57] ABSTRACT

The invention provides for the automatic and continuous cleaning of feed hoppers. A plurality of brushes extend transversely across the path of the upper flight of the horizontal conveyor in the bottom of a feed hopper. The brushes are spaced from each other and frictionally engage the teeth of the feed apron to convey good fibers to the feed apron at the end of the upper flight of the conveyor. A perforated plate is positioned beneath the lower flight of the conveyor and as the brushes traverse the plate on the lower flight they push accumulations of pepper trash through the perforations and into a removable pan beneath the perforated plate.

4 Claims, 3 Drawing Figures

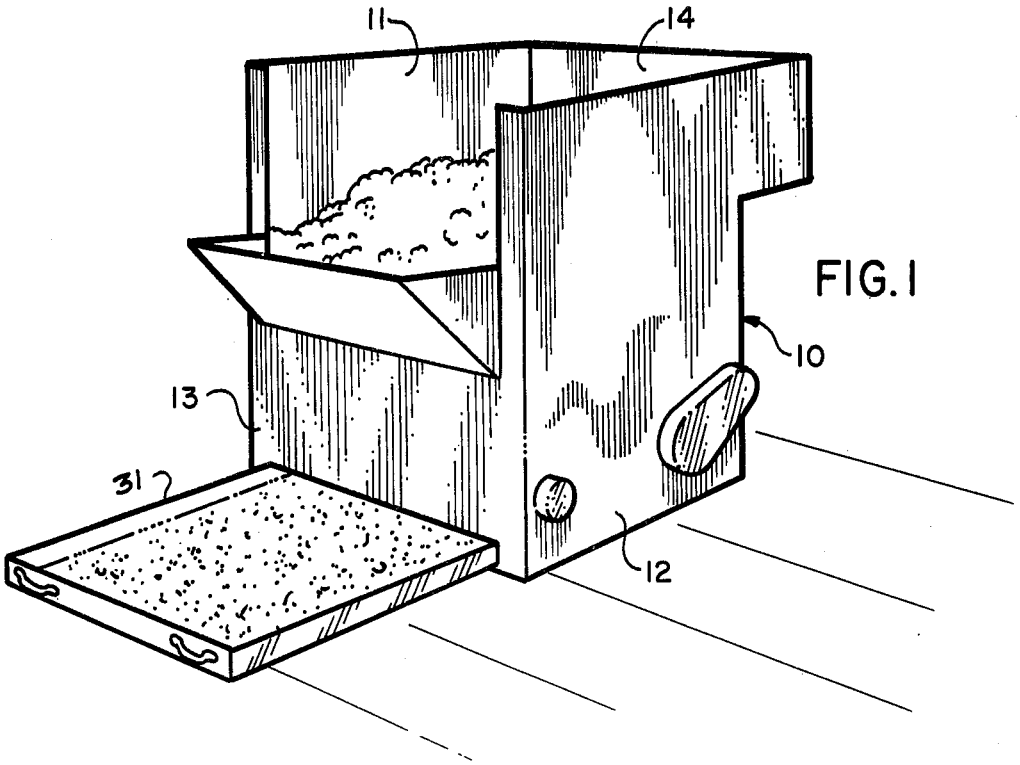
FIG. 1
FIG. 2
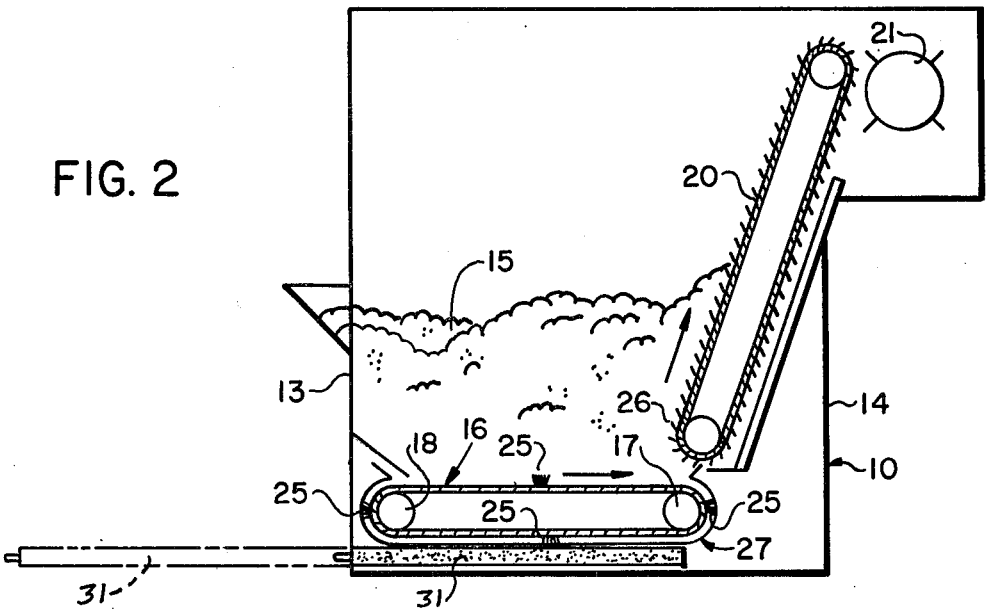

METHOD AND MEANS FOR CLEANING FEED HOPPERS

BACKGROUND OF THE INVENTION

Quantities of trash and good fiber accumulate in and around the feed hoppers in the opening rooms of textile plants. Great clumps of raw cotton and synthetic staple are fed directly from the bale into the feed hoppers and, particularly in the case of cotton, these clumps contain a large amount of trash because the cotton has not been cleaned.

The conventional feed hopper includes a horizontal conveyor on the bottom of the hopper and the upper flight of the conveyor moves forwardly to convey the fiber dumped in the top of the hopper to a feed apron which rises at an angle from the bottom of the conveyor and is provided with spikes to engage the fiber and move it out of the hopper and direct it to a processing machine. The movement of the conveyor and of the feed apron disturbs the fibers and attendant dirt, and quantities of fibers and dirt fall from the conveyor and feed apron, particularly at the transfer point between the conveyor and the feed apron. Heretofore, to applicant's knowledge, accumulations of fibers and trash falling from the conveyor and feed apron have been manually removed from the vicinity of the feed hoppers only by sweeping. Spinnable fibers mingle with the dirt and trash and are wasted in the prior art feed hoppers.

SUMMARY OF THE INVENTION

The desirable separation of spinnable fibers from pepper trash is continuously accomplished, according to the invention, by a plurality of brushes spaced horizontally from each other in the conveyor at the bottom of the hopper. The brushes extend across the conveyor and sequentially frictionally engage the spiked feed apron as the conveyor moves the brushes past the feed apron.

Spinnable fibers that would otherwise be carried beneath the conveyor are engaged by the brushes on the upper flight of the conveyor and transferred to the feed apron when the brushes are engaged by the spikes of the apron. The pepper trash that has been conventionally carried beneath the conveyor continues to be carried beneath the conveyor as it rotates but, according to the invention, a perforated plate is provided beneath the conveyor and the pepper trash falls on the perforated plate.

A removable tray is positioned beneath the perforated plate and movement of the brushes across the perforated plate on the lower flight of the conveyor pushes the pepper trash through the perforations in the plate and the trash accumulates in the removable tray which is periodically emptied manually.

The spaced brushes on the conveyor effectively separate the spinnable fibers from the pepper trash and a perforated plate and tray beneath the conveyor effectively remove the pepper trash on a continuing basis and contribute to the cleanliness of the hopper.

BRIEF DESCRIPTION OF THE DRAWINGS

FIG. 1 is a somewhat schematic perspective view of a feed hopper with the removable tray of the present invention shown in extended position for illustrative purposes;

FIG. 2 is a vertical sectional view taken substantially along the line 2—2 in FIG. 1.

DETAILED DESCRIPTION OF THE INVENTION

Figure 3:
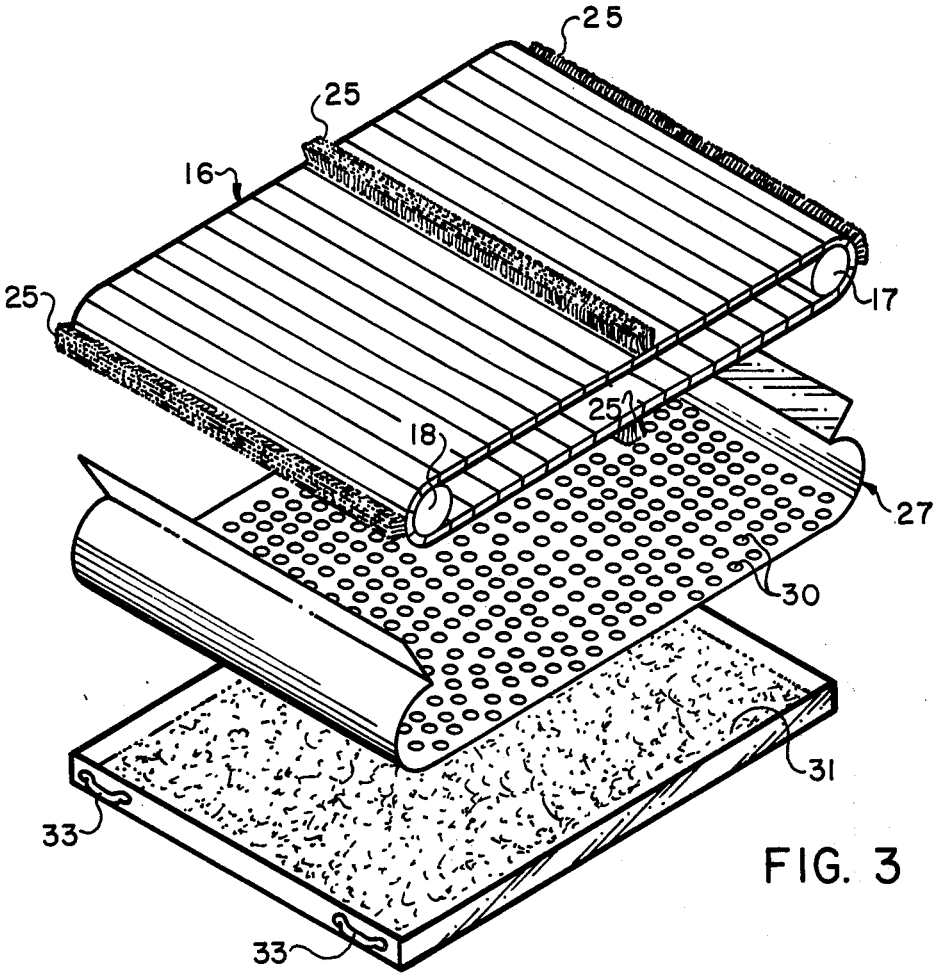
FIG. 3 is an exploded view of the brushes incorporated into the conveyor, the perforated plate, and the removable tray.

Referring more specifically to the drawings, the numeral 10 broadly designates a feed hopper comprising side walls 11 and 12, a rear wall 13 and a front wall 14. The hopper 10 has an open top through which clumps of cotton and/or synthetic fiber 15 are dumped into a conveyor broadly indicated at 16 in the bottom of the hopper.

The conveyor 16 comprises a plurality of wooden slats joined together as by fabric and trained around a sprocket 17 and an idler 18 at the front and rear of the hopper. The conveyor 16 rotates in a clockwise direction in FIG. 2 to present the fibers to a feed apron 20 extending upwardly at an angle from adjacent sprocket 17 to a take-off roll 21 at the top of the hopper 10.

The structure thus far described is conventional and it is with a structure of this type that the present invention is adapted to be used. According to the invention, brushes 25 are mounted at spaced intervals between adjacent wooden slats in conveyor 16, there being four brushes 25 in the illustrated embodiment of the invention. The brushes are equally spaced from each other and in the preferred form of the invention they accumulate spinnable fiber from the surface of the conveyor, it being noted in FIG. 3 that the brushes 25 extend all the way across the width of the conveyor. The brushes 25 are of a height sufficient to frictionally engage the spikes 26 on feed apron 20 as conveyor 16 moves brushes 25 successively past the lower end of feed apron 20. Accumulations of spinnable fiber on brushes 25 are transferred to feed apron 20 through engagement of brushes 25 by spikes 26.

Accumulations of short fibers and pepper trash on the surface of conveyor 16 are carried beneath conveyor 16 as it moves downwardly around sprocket 25. A plate 27 is spaced beneath the conveyor 16 to receive short fibers and pepper trash that fall from and through the conveyor. The forward and rear ends of plate 27 are curved to conform with the curvature of the sprocket 17 and the idler 18 and are spaced therefrom to guide the short fibers and pepper trash onto the planar central portion of plate 27 provided with apertures 30.

The perforated plate 27 is spaced sufficiently close to the lower flight of conveyor 16 to permit brushes 25 to frictionally engage the upper surface of plate 27 and move the short fibers and pepper trash accumulating on plate 27 through the apertures 30 into a removable tray 31 positioned beneath plate 27. Tray 31 has upstanding side walls 32 to retain a quantity of pepper trash and short fibers and is provided with handles 33 to facilitate removal of the tray 31 for periodic emptying.

There is thus provided an effective method and means for continually cleaning feed hoppers and separating spinnable fiber from the waste short fibers and pepper trash.

Although specific terms have been employed in the description of the illustrated embodiment of the invention they are used in a descriptive and generic sense only and not for purposes of limitation, the scope of the invention being defined in the claims.

I claim:

1. In a textile fiber feed hopper having a rotatable feed apron with a plurality of outwardly projecting spikes extending upwardly within the hopper and a horizontally movable conveyor in the lower portion of the hopper moving fibers toward the feed apron, the combination of spaced brush means fastened to the conveyor and projecting beyond the conveyor into sequential frictional engagement with spikes on the feed apron whereby spinnable fibers are transferred from said brush means to the feed apron.

2. A structure according to claim 1 wherein a plate is spaced beneath the conveyor, said plate having a plurality of apertures extending therethrough, and an imperforate end portion extending from the perforate portion of said plate beyond that portion of the conveyor adjacent the feed apron to guide waste beneath the conveyor.

3. A structure according to claim 2 wherein a removable tray is positioned beneath the perforated part of the plate.

4. A structure according to claim 2 wherein the perforated portion of the plate lies in the path of the brush means projecting beyond the conveyor.

* * * * *